US007524010B2

(12) United States Patent
Yamada

(10) Patent No.: US 7,524,010 B2
(45) Date of Patent: Apr. 28, 2009

(54) IMAGE RECORDING APPARATUS

(75) Inventor: Ryuji Yamada, Ogaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 88 days.

(21) Appl. No.: 11/710,931

(22) Filed: Feb. 27, 2007

(65) Prior Publication Data

US 2007/0200886 A1 Aug. 30, 2007

(30) Foreign Application Priority Data

Feb. 27, 2006 (JP) ..... P2006-049521

(51) Int. Cl.
*B41J 2/205* (2006.01)

(52) U.S. Cl. ..... 347/15; 347/43

(58) Field of Classification Search ..... 347/15, 347/43

See application file for complete search history.

(56) References Cited

U.S. PATENT DOCUMENTS 6,984,011 B2 * 1/2006 Shimada et al. ..... 347/19
2004/0080639 A1 4/2004 Ishiga
2005/0001907 A1 1/2005 Hoshuyama

FOREIGN PATENT DOCUMENTS

| | | |
|---|---|---|
| JP | 2001-337504 | 12/2001 |
| JP | 2003-244611 | 8/2003 |
| JP | 2005-25448 | 1/2005 |
| WO | WO 02/060186 A1 | 8/2002 |

* cited by examiner

*Primary Examiner*—Thinh H Nguyen
(74) *Attorney, Agent, or Firm*—McDermott Will & Emery LLP

(57) ABSTRACT

An image recording apparatus includes an inputting unit, a half-tone processing unit, a printing unit, a correction-value storing unit, and a dot-position correcting unit. The inputting unit inputs image information on an image. The half-tone processing unit performs, based on the image information, a half-tone process for setting a plurality of dots to be printed on a recording medium. The printing unit prints the plurality of dots on the recording medium. The correction-value storing unit stores a set of correction values for correcting positions of the plurality of dots on the recording medium. The set of correction values includes at least one correction value that is provided for each of the positions of the plurality of dots. The dot-position correcting unit corrects the positions of the plurality of dots based on the set of correction values, thereby obtaining output positions for printing the plurality of dots on the recording medium.

16 Claims, 9 Drawing Sheets

SHIFT IN HORIZONTAL DIRECTION
NORMAL
COLOR SHIFT
X
Y

SHIFT IN VERTICAL DIRECTION
NORMAL
COLOR SHIFT
X
Y

FIG.4

| ADDRESS | X-OFFSET | Y-OFFSET |
|---|---|---|
| 00001 | 0 | 0 |
| 00002 | 0 | 0 |
| 00003 | 0 | 0 |
| 00004 | 0 | 0 |
| ⋮ | | |
| 00500 | −1 | 0 |
| 00501 | −1 | 0 |
| 00502 | −1 | 0 |
| ⋮ | | |
| 01500 | −1 | −2 |
| 01501 | −1 | −2 |
| 01502 | −1 | −2 |

COLOR SHIFT CORRECTION TABLE

IMAGE RECORDING APPARATUS

CROSS REFERENCE TO RELATED APPLICATIONS

This application claims priority from Japanese Patent Application No. 2006-049521 filed Feb. 27, 2006. The entire content of the priority application is incorporated herein by reference.

TECHNICAL FIELD

The present invention relates to an image recording apparatus capable of preventing color shift in performing printing by superimposing a plurality of colors on a recording medium and an image processing program for processing images.

BACKGROUND

In performing color printing with image recording apparatuses such as a color electrophotographic printer (laser printer), desired colors are reproduced by superimposing a plurality of colors such as CMYK (Cyan, Magenta, Yellow, and Black). However, there occur various unevenness and allocation errors in a mechanism conveying a recording medium, thereby causing color shift in which the printing positions of a plurality of superimposed colors are shifted. Japanese Patent Application Publication No. 2001-337504 discloses a method of correcting color shift for each color for preventing such a color shift.

SUMMARY

In conventional image recording apparatuses and image processing programs, a color shift can be corrected for each color or for each line, however, shift of each dot at the printing positions of the recording medium cannot be corrected individually. Accordingly, there is a problem that the printed colors are not even on the printing surface.

In view of the foregoing, it is an object of the invention to provide an image recording apparatus and an image processing program that can easily correct a shift of each dot at printing positions on a recording medium.

In order to attain the above and other objects, the invention provides an image recording apparatus. The image recording apparatus includes an inputting unit, a half-tone processing unit, a printing unit, a correction-value storing unit, and a dot-position correcting unit. The inputting unit inputs image information on an image. The half-tone processing unit performs, based on the image information, a half-tone process for setting a plurality of dots to be printed on a recording medium. The printing unit prints the plurality of dots on the recording medium. The correction-value storing unit stores a set of correction values for correcting positions of the plurality of dots on the recording medium. The set of correction values includes at least one correction value that is provided for each of the positions of the plurality of dots. The dot-position correcting unit corrects the positions of the plurality of dots based on the set of correction values, thereby obtaining output positions for printing the plurality of dots on the recording medium.

According to another aspect, the invention also provides a storage medium storing a set of program instructions executable on an image processing apparatus. The set of program instructions includes: inputting image information on an image; performing, based on the image information, a half-tone process for setting a plurality of dots to be printed on a recording medium; and correcting positions of the plurality of dots on the recording medium based on a set of correction values stored in a correction-value storing unit, the set of correction values including at least one correction value that is provided for each of the positions of the plurality of dots, thereby obtaining output positions for printing the plurality of dots on the recording medium.

BRIEF DESCRIPTION OF THE DRAWINGS

Embodiments in accordance with the invention will be described in detail with reference to the following figures wherein:

FIG. 4 shows a correction table for storing correction values for correcting pixel positions;

DETAILED DESCRIPTION

An image recording apparatus and image processing program according to a first embodiment of the invention will be described while referring to FIGS. 1 through 5.

Figure 1:
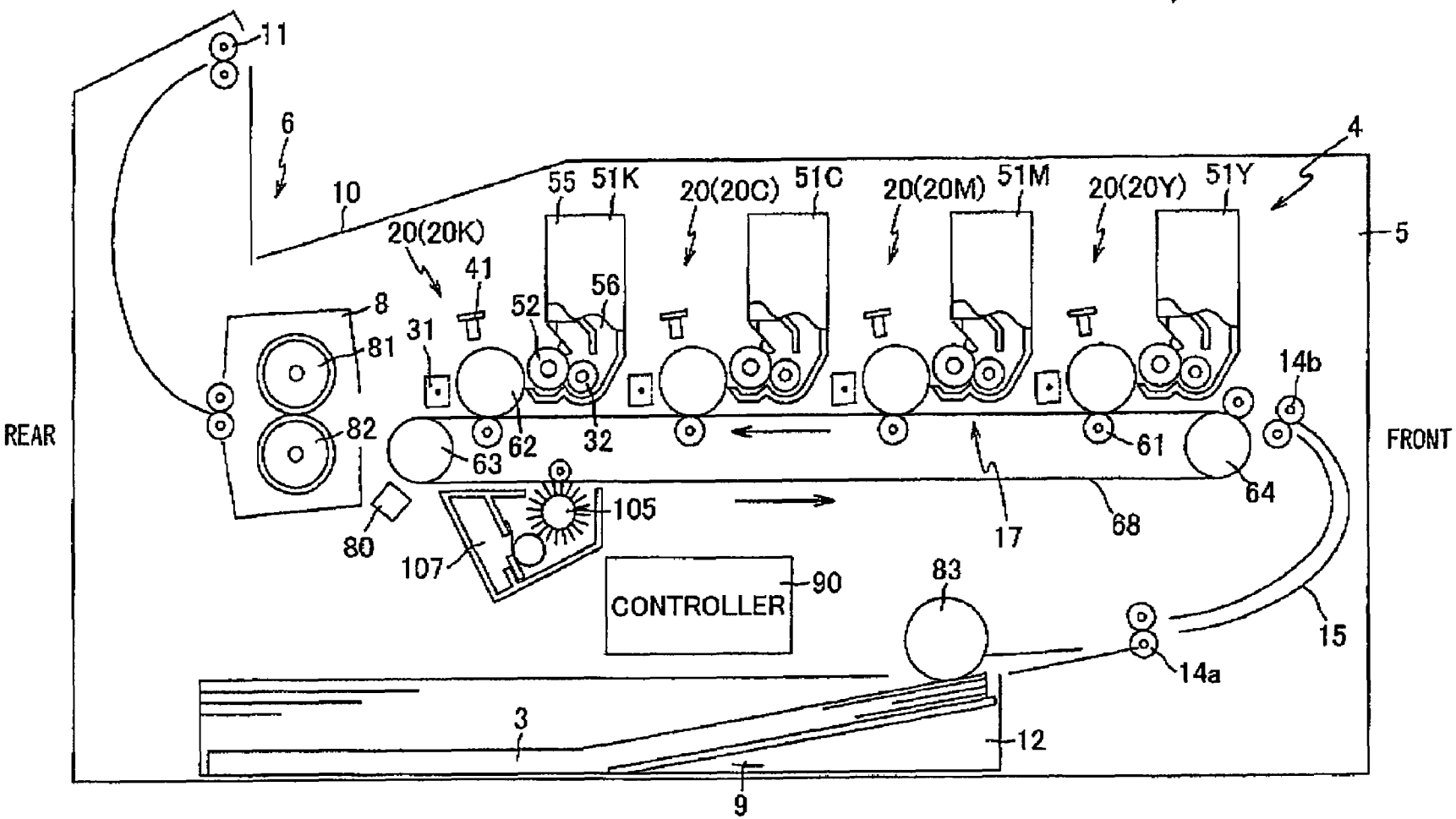
FIG. 1 is a vertical cross-sectional view showing an overall configuration of a color electrophotographic printer according to a first embodiment of the invention.

FIG. 1 is a vertical cross-sectional view showing an overall configuration of a color electrophotographic printer 1 according to the first embodiment. As shown in FIG. 1, the color electrophotographic printer 1 is a transverse tandem-type printer in which four image forming units 20 are arranged in series in a horizontal direction. The printer 1 includes a paper feed section 9, an image forming section 4, a paper discharging section 6, and a controller 90. The paper feed section 9 feeds sheets of recording paper 3 to a main casing 5. The image forming section 4 forms images on the fed recording paper 3. The paper discharging section 6 discharges the recording paper 3 on which images have been formed. The controller 90 controls the color electrophotographic printer 1.

The paper feed section 9 includes a paper feed tray 12, a paper feed roller 83 and conveying rollers 14*a* and 14*b*. The paper feed tray 12 is detachably mounted on the main casing 5 from the front side (right side in FIG. 1) in the bottom of the main casing 5. The paper feed roller 83 is provided at one end (at the front side) of the paper feed tray 12. The conveying rollers 14*a* and 14*b* are provided on the downstream side in the conveying direction of the recording paper 3 with respect to the paper feed roller 83 at the front side of the paper feed roller 83.

A plurality of sheets of the recording paper 3 are stacked in the paper feed tray 12. The uppermost sheet of the recording paper 3 is fed towards the conveying rollers 14*a* and 14*b* by rotations of the paper feed roller 83 and is conveyed sequentially between a conveying belt 68 and each of photosensitive drums 62.

In the middle portion of the main casing 5, the image forming section 4 includes four image forming units 20Y, 20M, 20C, and 20K for forming images, a transfer section 17, and a fixing section 8. The transfer section 17 transfers images formed by each of the image forming units 20 to the recording paper 3. The fixing section 8 fixes the images transferred to the recording paper 3 by heating and pressurizing the same. The above-described subscripts Y, M, C, and K represent the colors of Yellow (Y), Magenta (M), Cyan (C), and Black (K), respectively.

Each of the image forming units 20 has a photosensitive drum 62 as an image bearing member, a charger 31, an exposure unit 41, and developing units 51Y, 51M, 51C and 51K. The charger 31 is provided adjacent to the photosensitive drum 62 for charging the same. The exposure unit 41 forms electrostatic latent images on the photosensitive drum 62. The developing units 51Y, 51M, 51C, and 51K form toner images by providing toner as a developing agent to the photosensitive drum 62, using a development bias applied between the photosensitive drum 62 and developing units 51Y, 51M, 51C, and 51K.

The charger 31 is, for example, a Scorotron charger generating corona discharge from a discharging wire made of tungsten and evenly charging the surface of the photosensitive drum 62 in a positive polarity. The exposure unit 41 includes an LED array emitting light for forming electrostatic latent images on the surface of the photosensitive drum 62. In this exposure unit 41, light emitted from the LED array is irradiated on the photosensitive drum 62, and electrostatic latent images are formed on the surface of the photosensitive drum 62. The exposure unit 41 need not be an LED array, but may be an exposure unit that emits laser light.

The developing unit 51 is provided with a hopper 56, a supply roller 32, and a developing roller 52 in a developing casing 55. The hopper 56 is formed as inner space of the developing casing 55, and the toners of Yellow, Magenta, Cyan and Black are contained therein for each of the image forming units 20. That is, the above-described four image forming units 20 include an image forming unit 20Y in which a toner of Yellow is contained in the hopper 56, an image forming unit 20M in which a toner of Magenta is contained in the hopper 56, an image forming unit 20C in which a toner of Cyan is contained in the hopper 56, and an image forming unit 20K in which a toner of Black is contained in the hopper 56. Four image forming units 20 only have different colors of toners and have the same configuration.

The supply roller 32 is provided below the hopper 56. A roller portion made of a conductive sponge member is covered on a metallic roller shaft of the supply roller 32. The supply roller 32 is rotatably supported so as to rotate in a direction opposite to the developing roller 52 in a nip portion in contact with the developing roller 52.

At a side of the supply roller 32, the developing roller 52 is rotatably provided in a position in contact with the supply roller 32. A roller portion made of an elastic member such as a conductive rubber material is covered on a metallic roller shaft of the developing roller 52. A developing bias voltage is applied from a power source 110 (see FIG. 2) to the developing roller 52.

The transfer section 17 is provided so as to be opposed to the photosensitive drum 62 in the main casing 5 and has a conveying belt driving roller 63, a conveying belt follow roller 64, a conveying belt 68 which is an endless belt, and a transfer roller 61. The conveying belt follow roller 64 is provided on the upstream side of the photosensitive drum 62 of the image forming unit of Yellow 20Y located on the most upstream side with respect to the conveying direction of the recording paper 3 as well as at the upper front side of the paper feed roller 83.

The conveying belt driving roller 63 is provided on the downstream side of the photosensitive drum 62 of the image forming unit of Black 20K located on the most downstream side with respect to the conveying direction of the recording paper 3 as well as on the upstream side of the fixing section 8. The conveying belt 68 is wound around between the conveying belt driving roller 63 and the conveying belt follow roller 64 and is provided so as the outer surface thereof to be brought into contact with all the photosensitive drums 62 of the image forming units 20. The conveying belt 68 is circularly moved in a counter-clockwise direction between the conveying belt driving roller 63 and the conveying belt follow roller 64 by being driven by the conveying belt driving roller 63.

The transfer roller 61 is provided so as to be opposed to the photosensitive drum 62 of each of the image forming units 20 with interposing the conveying belt 68 therebetween inside the loop of the conveying belt 68. A roller portion made of an elastic member such as a conductive rubber material is covered on a metallic roller shaft. In a transfer operation, a predetermined voltage is applied between the transfer roller 61 and the photosensitive drum 62 in a direction in which toner images borne on the photosensitive drum 62 are transferred to the recording paper 3.

The fixing section 8 is provided on the downstream side of the image forming unit 20 and the transfer section 17, and has a heating roller 81 and a pressure roller 82. The heating roller 81 is made of a metallic pipe, on the surface of which release layers are formed. A halogen lamp is provided in the heating roller 81 along the axial direction thereof, and the surface of the heating roller 81 is heated to a fixing temperature by the halogen lamp. The pressure roller 82 is provided so as to pressurize the heating roller 81.

The paper discharging section 6 is provided on the downstream side of the fixing section 8 in the upper portion of the main casing 5, and includes a pair of paper discharging rollers 11 and a paper discharging tray 10. The pair of paper discharging rollers 11 discharges the recording paper 3 on which images have been fixed to the paper discharging tray 10. The paper discharging tray 10 is provided on the downstream side of the paper discharging roller 11 for accumulating the sheets of the recording paper 3 having completed the image forming process.

The density sensor 80 is provided obliquely rearward below the conveying belt driving roller 63 so as to oppose the outer surface of the conveying belt 68. The density sensor 80 is configured to detect patches formed on the conveying belt 68 and the like. A toner collecting device 107 is provided obliquely forward below the conveying belt driving roller 63, so that a toner collecting roller 105 of the toner collecting device 107 is in contact with the outer surface of the conveying belt 68. The toner collecting device 107 is for collecting toner (patches and the like described above) adhered to the conveying belt 68.

Figure 2:
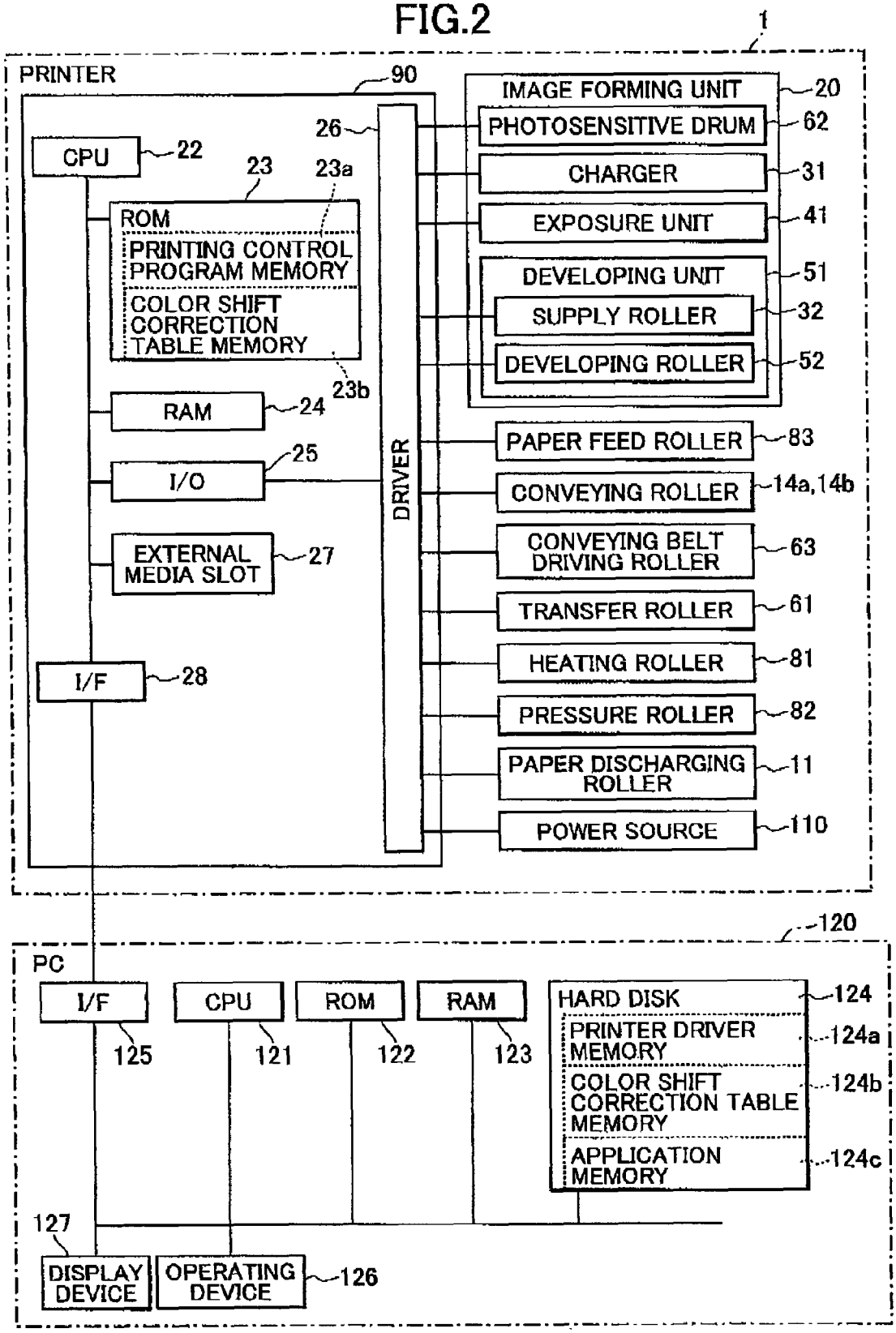
FIG. 2 is a block diagram showing electric configuration of the color electrophotographic printer and a personal computer according to the first embodiment.

An electric configuration of the color electrophotographic printer 1 and a personal computer 120 (hereinafter, referred to as PC) providing image information to the color electrophotographic printer 1 will be described with reference to FIG. 2. As shown in FIG. 2, the color electrophotographic printer 1 is provided with a controller 90 for controlling each component of the apparatus comprehensively. The printer 1 is configured to send control signals to each of the image forming units 20, the is paper supply roller 83, the conveying rollers 14*a* and 14*b*, the conveying belt driving roller 63, the transfer roller 61, the heating roller 81, the pressure roller 82, the paper discharging roller 11, and the power source 110 via a driver 26 which is part of the controller 90.

The controller 90 includes a CPU 22, a ROM 23, a RAM 24, an I/O 25, a driver 26, an external media slot 27, and an interface (hereinafter referred to as I/F) 28. The CPU 22 is a microprocessor executing various programs stored in the ROM 23. RAM 24 is a memory having a work area in which variables are temporarily stored when the CPU 22 executes the programs. The ROM 23 is a read-only memory storing various programs executed by the CPU 22 as well as constants and tables to be referred to in executing the programs.

The ROM 23 includes a printing control program memory 23*a* for storing a printing control program (image processing program) as a control program and a color shift correction table memory 23*b* for storing a color shift correction table. The printing control program is a program for converting color image information inputted from a medium mounted in the external media slot 27 into printing information for performing printing by the color electrophotografic printer 1.

The inputted color image information has values of RGB or the like. In order to perform printing in an optimal condition in the color electrophotographic printer 1, a color conversion processing, a halftone processing, and a color shift correction processing are executed. In the color conversion processing, the above-described RGB values are converted into CMYK values (printing information) by using a lookup table so as to match ink used for printing, the type of printing paper, and the resolution of printing. In the halftone processing, the information converted by the color conversion processing is further converted to binary values. In the color shift correction processing, the positions of dots set by the halftone processing are corrected so as to prevent a color shift.

The color shift correction table is a table to be referred to in the color shift correction processing and stores correction values in X- and Y-directions in accordance with the coordinate positions on the printing surface.

The external media slot 27 can detachably mount external media storing image information (image data) obtained by a digital camera or the like, and inputs image information (RGB values) directly from a mounted external medium.

The interface 28 is an interface for communicating with an external device by USB standard or the like, and can input image information from the PC 120 or a digital camera.

The PC 120 includes a CPU 121, a ROM 122, a RAM 123, a hard disk 124, an interface 125, an operating device 126, and a display device 127. The CPU 121 is a microprocessor executing various programs stored in the ROM 122 and the hard disk 124. RAM 123 is a memory having a work area in which the programs stored in the hard disk 124 is stored or in which variables are temporarily stored when the CPU 121 executes the programs.

The hard disk 124 includes a printer driver memory 124*a* for storing a printer driver, a color shift correction table memory 124*b* for storing a color shift correction table, and an application memory 124*c* for storing various application software.

The printer driver stored in the printer driver memory 124*a* is program supplied by a CD-ROM or the like attached to the color electrophotographic printer 1. This printer driver creates printing data by converting image data of RGB into printing data of CMYK as well as data for suitably controlling the color electrophotographic printer 1. The printer driver is installed into the hard disk 124 from the CD-ROM mounted in a CD-ROM drive (not shown) provided in the PC 120.

The color shift correction table stored in the color shift correction table memory 124*b* is supplied together with the printer driver by the CD-ROM, and is referred to in executing the color shift correction processing included in the printer driver. This color shift correction table will be described later with reference to FIG. 4.

The various application software stored in the application memory 124*c* include image processing software for editing pictures taken by a digital camera, word processing software for creating documents and tables, and the like. The application software creates image information.

In printing the image information, the created image information is converted into the printing information by the printer driver and is outputted to the color electrophotographic printer 1.

The interface 125 is an interface by a USB standard or the like for communicating with an external device via a cable. The interface 125 can input image information obtained by a digital camera or the like, or can output the printing information to the color electrophotographic printer 1.

The operating device 126 includes a keyboard and a mouse for making the various settings of the PC 120 and for inputting characters. The display device 127 is a liquid crystal display, for example. The display device 127 displays setting screen on which various values are set by a user when the CPU 121 executes a program and displays images formed based on the set values.

Figures 3A, 3B:
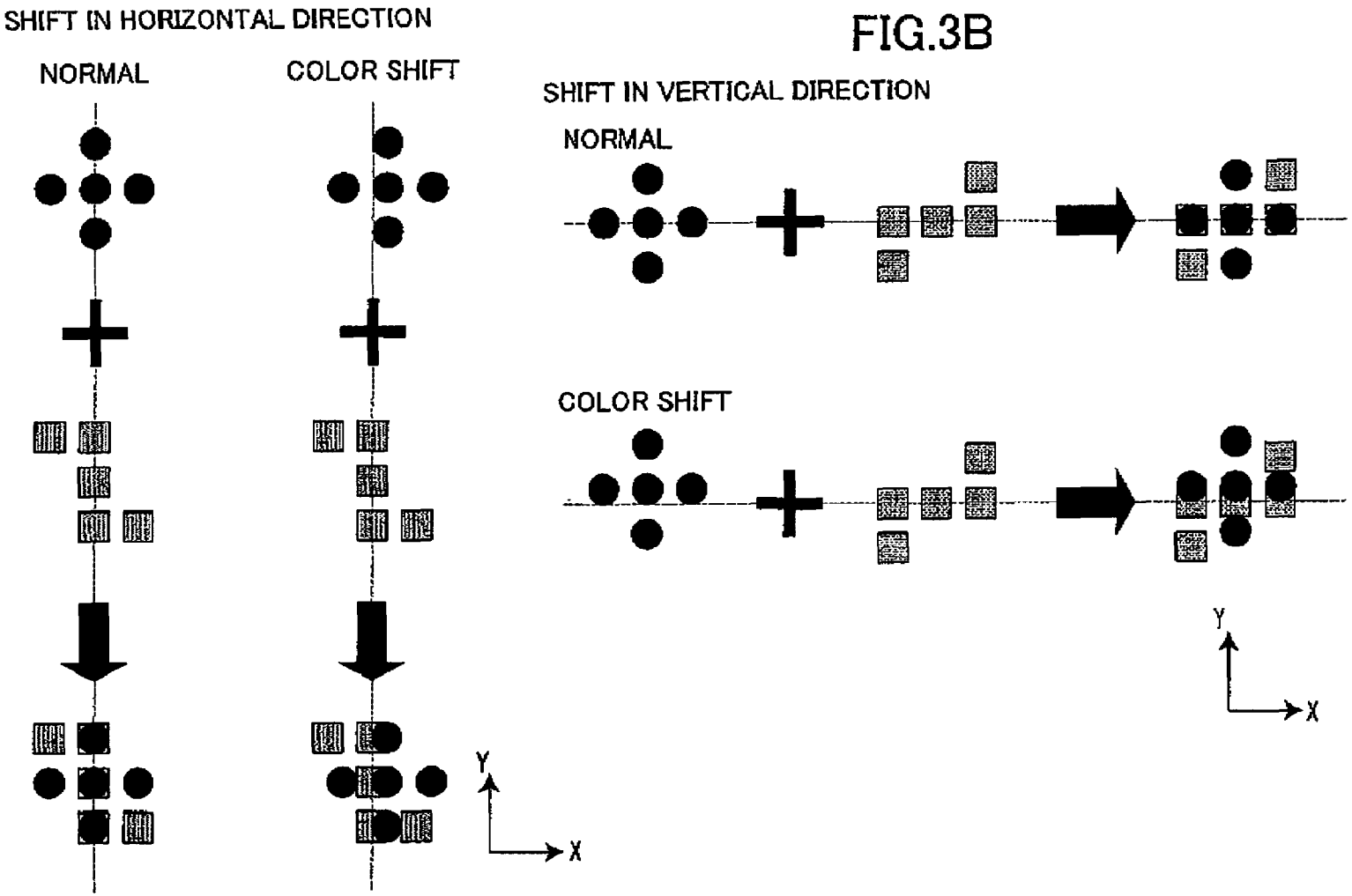
FIG. 3A is an explanatory drawing showing a case in which color shift has occurred in a horizontal direction (X-direction) in comparison to a normal case, wherein the normal case is shown on the left side and the case of color shift is shown on the right side.
FIG. 3B is an explanatory drawing showing a case in which color shift has occurred in a vertical direction (Y-direction) in comparison to a normal case, in which the normal case is shown on the upper side and the case of color shift is shown on the lower side.

A method of correcting color shift will be described with reference to FIGS. 3A through 4. FIGS. 3A and 3B are explanatory drawings showing states in which color shift is caused. FIG. 4 shows a color shift correction table to be referred to in a color shift processing for correcting color shift.

FIG. 3A shows a case in which color shift has occurred in a horizontal direction (X-direction) in comparison to a normal case. The normal case is shown on the left side of FIG. 3A, and the case of color shift is shown on the right side. FIG. 3A schematically shows that an image is formed by superimposing pixels of one color (for example, magenta) represented by five black dots on pixels of another color (for example, cyan) represented by squares. In the normal case, superimposed pixels are positioned correctly. That is, square pixels and black dot pixels are superimposed in aligned positions (correct positions), allowing three vertical rows to be aligned. Also, pixels allocated in separate positions are located at correct positions at which the square pixels and black dot pixels in different rows do not contact or overlap with each other.

In contrast, in case of color shift, black dots are shifted slightly to the right side on the printing surface (in X direction) from the correct positions. That is, squares and black dots in the three vertical rows are shifted from each other. Also, pixels allocated so as not to overlap with each other are located in contact with other pixels due to shifted positions.

FIG. 3B shows a case in which color shift has occurred in a vertical direction (Y-direction) in comparison to the normal case. The normal case is shown on the upper side of FIG. 3B, and the case of color shift is shown on the lower side thereof. In the normal case, superimposed printed pixels are positioned correctly. That is, three horizontal rows in which square pixels and black dot pixels are superimposed in aligned positions (correct positions). Also, pixels allocated in separate positions are located at correct positions at which the square pixels and black dot pixels in different rows do not contact or overlap with each other.

In contrast, in case of color shift, black dots are shifted slightly to the upper side on the printing surface (in Y direction) from the correct positions. That is, squares and black dots in the three horizontal rows are shifted from each other. Also, pixels allocated so as not to overlap with each other are located in contact with other pixels due to shifted positions.

Accordingly, in the present embodiment, positions on the printing surface in which the color shift occurs are detected in advance and stored in a memory. In the positions in which the color shift occurs, the memory is referred to for correcting the color shift, thereby enabling pixels to be located in correct positions.

More specifically, when detecting the color shift, each of the four image forming units 20Y, 20M, 20C, and 20K forms, on the conveying belt 68, a plurality of lines (patches) which extends in the main scanning direction. Then, the density sensor 80 detects the plurality of lines (patches). This operation is performed for each of CMYK colors. The controller 90 compares differences in detection timing between the CMYK colors, thereby detecting the color shift. Alternatively, if the color electrophotographic printer 1 has four density sensors for each of CMYK colors, detection can be performed at the same time.

Note that FIGS. 3A and 3B show cases where color shift has occurred by less than one dot (approximately half a dot). In other words, the black dots and the square marks in FIGS. 3A and 3B are shifted by a distance less than one dot. In such a case, for example, the controller 90 determines that either the color shift has occurred by one dot or no color shift has occurred, depending on the distance of shift.

FIG. 4 shows a part of a color shift correction table (a set of correction values) for performing the correction for one of CMYK colors, In other words, the color correction table (the set of correction values) is stored for each of CMYK colors. The color shift correction table is stored in the color shift correction table memory 23*b* in the ROM 23. The color shift correction table stores offset values in dots for correcting shifts in X- and Y-directions at each (X, Y) position on the printing paper 3. Addresses in the table are in a one-to-one correspondence with (X, Y) coordinate positions on the printing paper 3.

In FIG. 4, the offset values are equal to zero in both X- and Y directions at addresses 0001 to 0004. At addresses 00500 to 00502, the offset values in X-direction are minus one (−1) such that the pixels are shifted by one dot in the minus direction (to the left), and the offset values in Y-direction are equal to zero. At addresses 01500 to 01502, the offset values in X direction are minus one (−1) such that the pixels are shifted by one dot in the minus direction, and the offset values in Y-direction are minus two (−2) such that the pixels are shifted by two dots in the minus direction.

Figure 5:
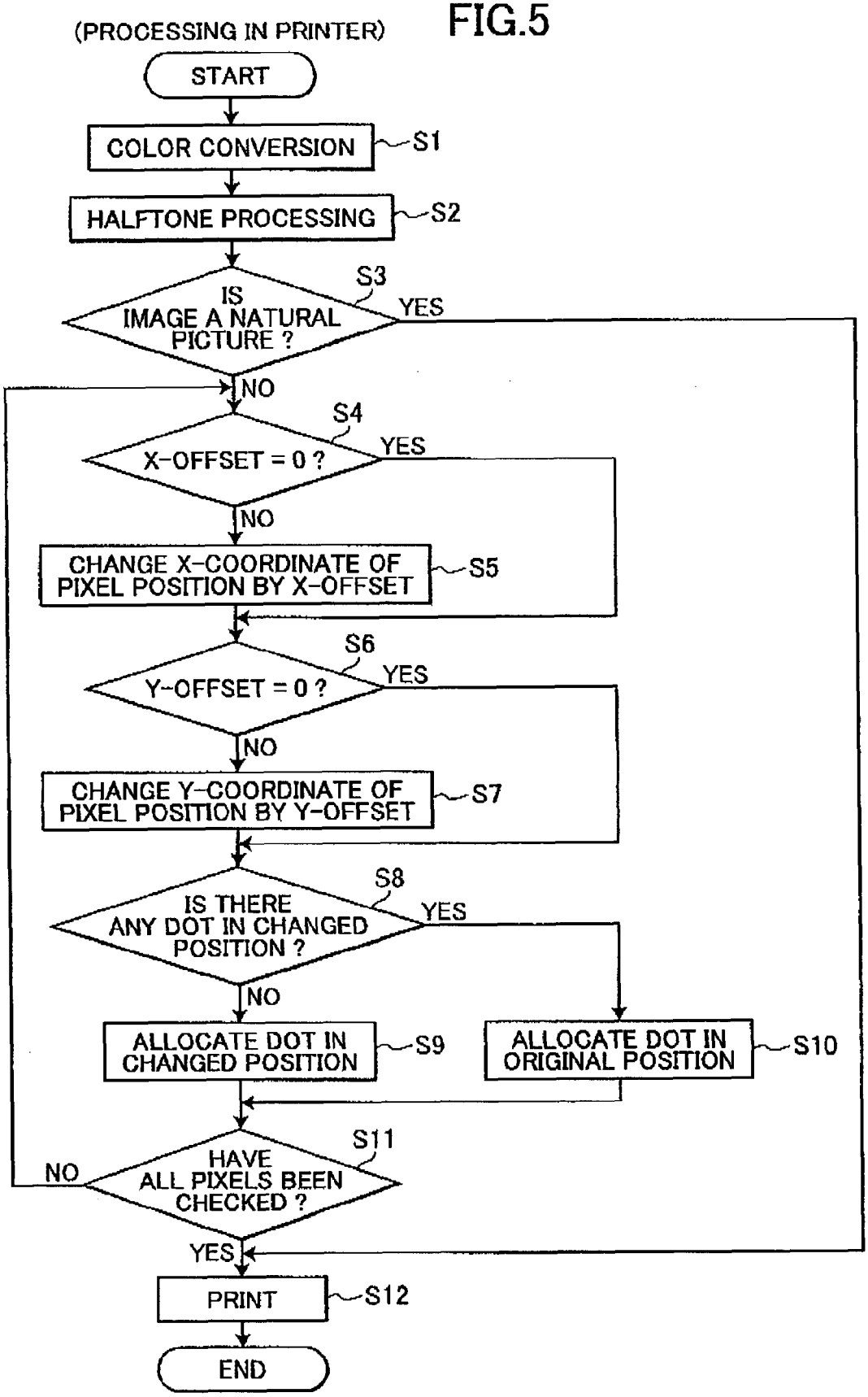
FIG. 5 is a flowchart showing a print processing in the color electrophotographic printer.

Next, print processing executed in the color electrophotographic printer 1 (serving as an image processing apparatus) will be described with reference to a flowchart of FIG. 5. This print processing is a processing executed when a user operates an operating device (not shown) for starting a printing operation based on image information stored in an external medium mounted in the external media slot 27.

In S1, the CPU 22 of the color electrophotographic printer 1 converts image information (RGB) stored in an external medium into printing information (CMYK) by a color conversion program stored in the color conversion program memory 23*a* in the ROM 23. In S2, the CPU 22 executes a halftone processing in which density values (256 tones represented in eight-bit) are converted into binary values (0 or 1). In this halftone processing, well-known dither method or error diffusion method is used, for example.

In S3, the CPU 22 determines whether the type of the image information stored in the external medium is a natural picture. The CPU 22 makes this determination based on an extension of a filename of the image information. For example, if the extension is "jpg", the CPU 22 determines that the image information is a natural picture of JPEG format taken by a digital camera or the like. If the extension is "doc", the CPU 22 determines that the image information is a document created by a word processor.

If the type of the image information is a natural picture (S3: Yes), in S12 the CPU 22 executes the print processing without any corrections because a picture in a better quality can be printed without color shift correction, If the type of the image information is not a natural picture (S3: No), the positions of dots are corrected with reference to the color shift correction table. In S4, the CPU 22 determines whether the X-offset stored in the color shift correction table for the position of a dot to be corrected is equal to zero. If the X-offset is not equal to zero (S4: No), in S5 the CPU 22 changes the position of the dot in X-direction by a distance stored in the correction table, and temporarily stores the changed position in the work area of the RAM 22. If the X-offset is equal to zero (S4: Yes), or if the processing in S5 has been completed, in S6 the CPU 22 determines whether the Y-offset for the dot in the color correction table is equal to zero. If the Y-offset is not equal to zero (S6: No), in S7 the CPU 22 changes the position of the dot in Y-direction by a distance stored in the correction table, and temporarily stores the changed position in the work area of the RAM 22.

If the Y-offset is equal to zero (S6: Yes), or if the processing in S7 has been completed, in S8 the CPU 22 determines whether a dot (a dot in the same color) already exists in the (X, Y) position stored in the work area of the RAM (S8). If no dot exists in the changed position (S8: No), in S9 the CPU 22 allocates a dot in the changed position. If a dot already exists in the changed position (S8: Yes), in S10 the CPU 22 allocates the dot in the original position. In S11, the CPU 22 determines whether this series of processing has been executed for all pixels. If there are yet any unprocessed pixels (S11: No), the processing returns to S4. If all pixels have already been processed, in S12 the CPU 22 executes a printing operation based on the processed image information. Note that the processing in S4 to S11 is executed for each of CMYK colors. After the processing for all the colors have been completed, the printing operation in S12 is executed.

As described above, in the color electrophotographic printer 1 of the first embodiment, the color shift correction table memory 23*b* of the ROM 23 stores values for correcting the coordinate positions on the printing surface at which pixels are allocated. The position of each of the pixels to be printed is corrected with reference to the color shift correction table. At this time, the CPU 22 determines whether the image information is a natural picture based on the extension of the filename of the inputted image information. If the image information is a natural picture such as a photograph, the color electrophotographic printer 1 is controlled so as not to perform any correction. This is because, if the image is a natural picture, a visible color shift is not likely to occur and printing in high quality can be performed. If the image is a line drawing or a character, the printing positions of pixels are corrected, thereby performing printing in high quality.

An image recording apparatus and image processing program according to a second embodiment of the invention will be described while referring to FIGS. 6 through 9, wherein like parts and components are designated by the same reference numerals to avoid duplicating description.

According to the above-described first embodiment, the correction processing is executed by the color electrophotographic printer 1. However, according to the second embodiment, the correction processing is executed by a printer driver installed in the hard disk 124 of the PC 120 (serving as an image processing apparatus). The color shift correction table stored in the color shift correction table memory 124*b* of the hard disk 124 is referred to in the color shift correction processing executed by the printer driver.

In this processing executed by the printer driver, images such as pictures and characters are formed by application software installed in the PC 120. The application software provides a command corresponding to the type of an image to the printer program together with image data. Then, determination is made according to the type of the command whether the image is a natural picture.

Accordingly, even when natural pictures, characters, and lines are mixed on one sheet of the recording paper, an optimal processing can be executed for each image.

Figure 6:
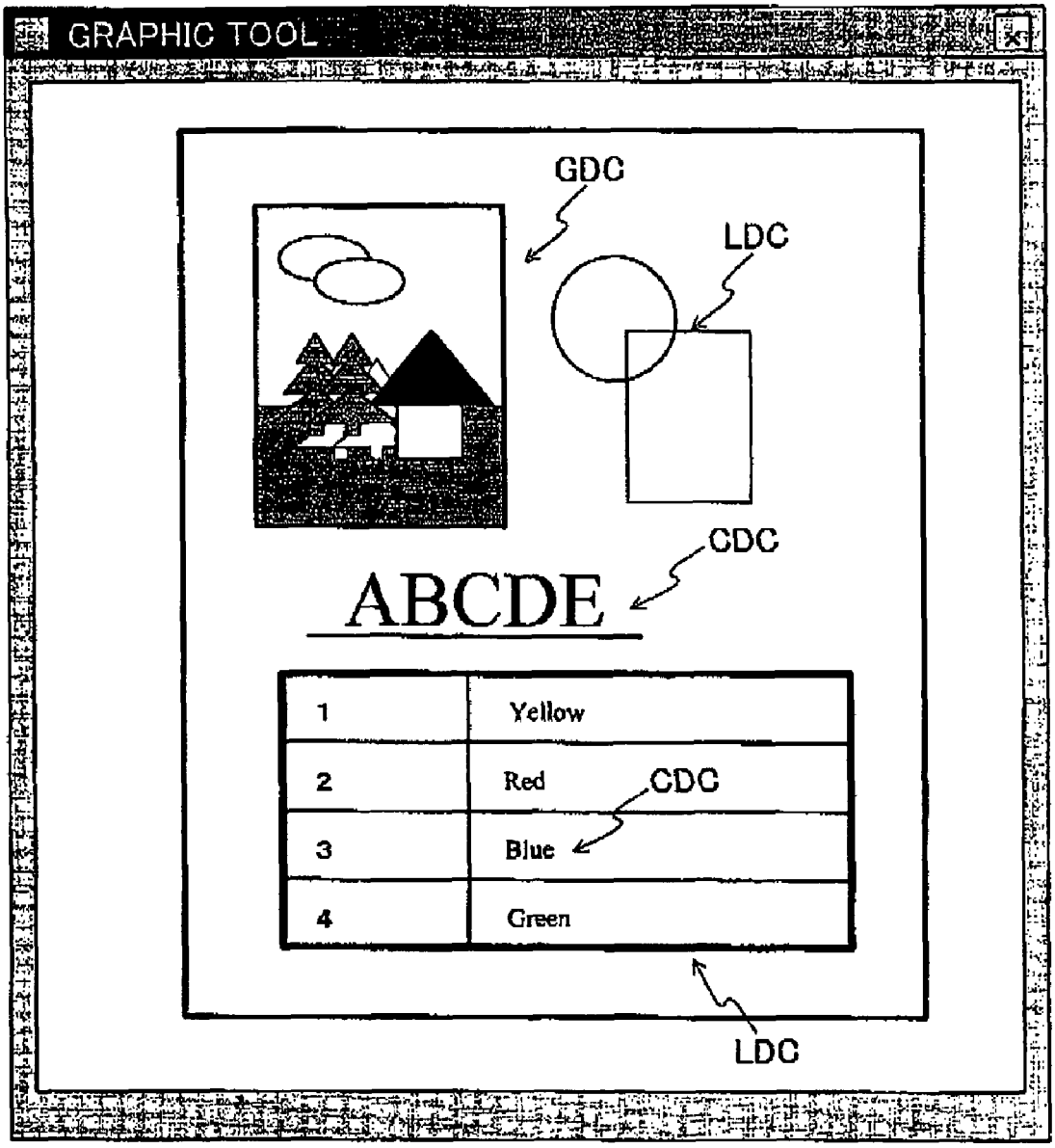
FIG. 6 shows an example of an image that is processed according to a second embodiment of the invention.

FIG. 6 is a view showing an image which is created by a graphic tool. The image contains a plurality of image parts including a graphic drawing part such as a photograph, a line drawing part such as a figure, and a character drawing part including characters (texts).

In this image, the graphic drawing part is created by a graphic drawing command (CDC), the line drawing and the ruled lines of the table (the line drawing part) are created by a line drawing command (LDC), and the character drawing part is created by a character drawing command (CDC).

Figure 7:
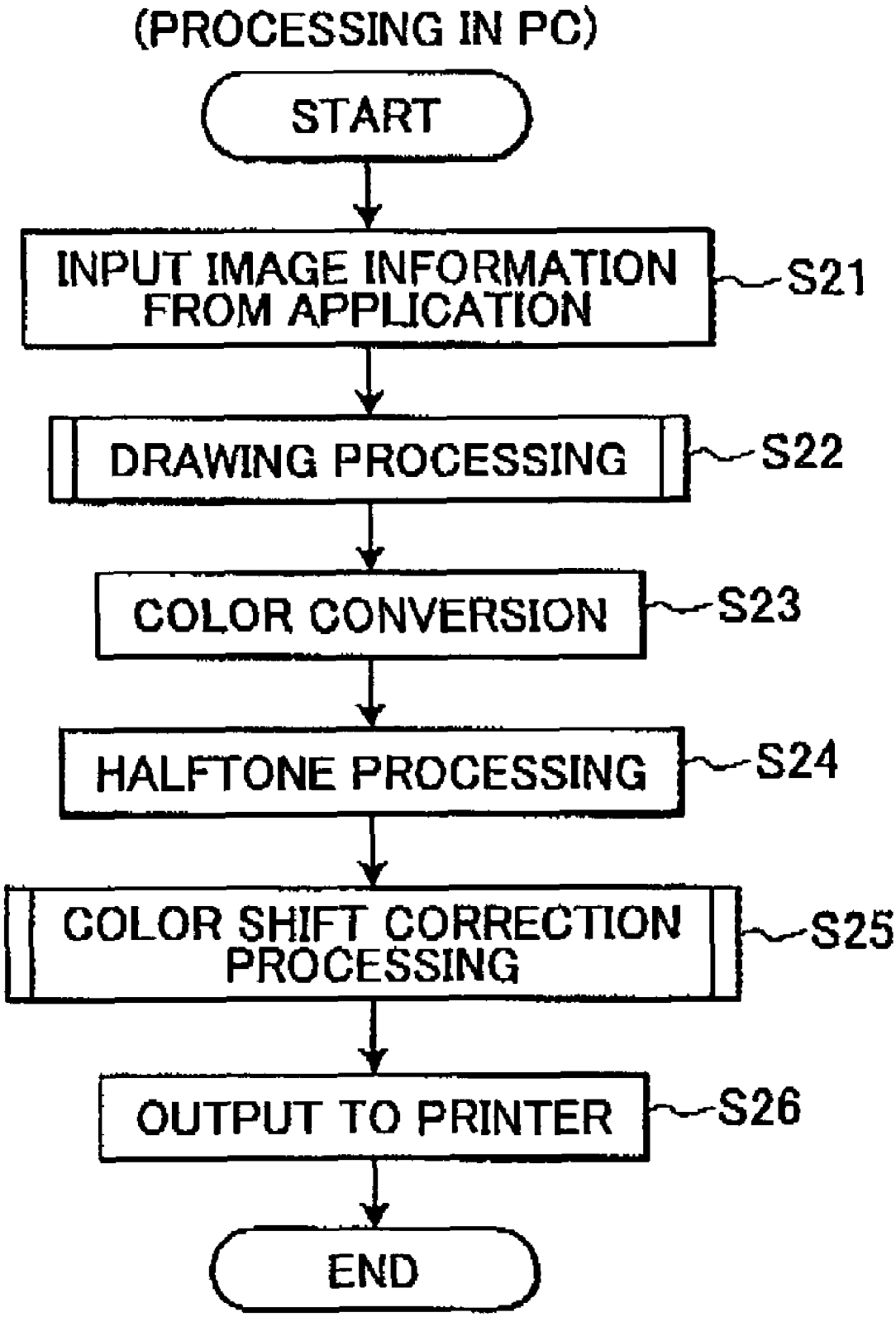
FIG. 7 is a flowchart showing a print processing executed by a printer driver according to the second embodiment.
Figure 8:
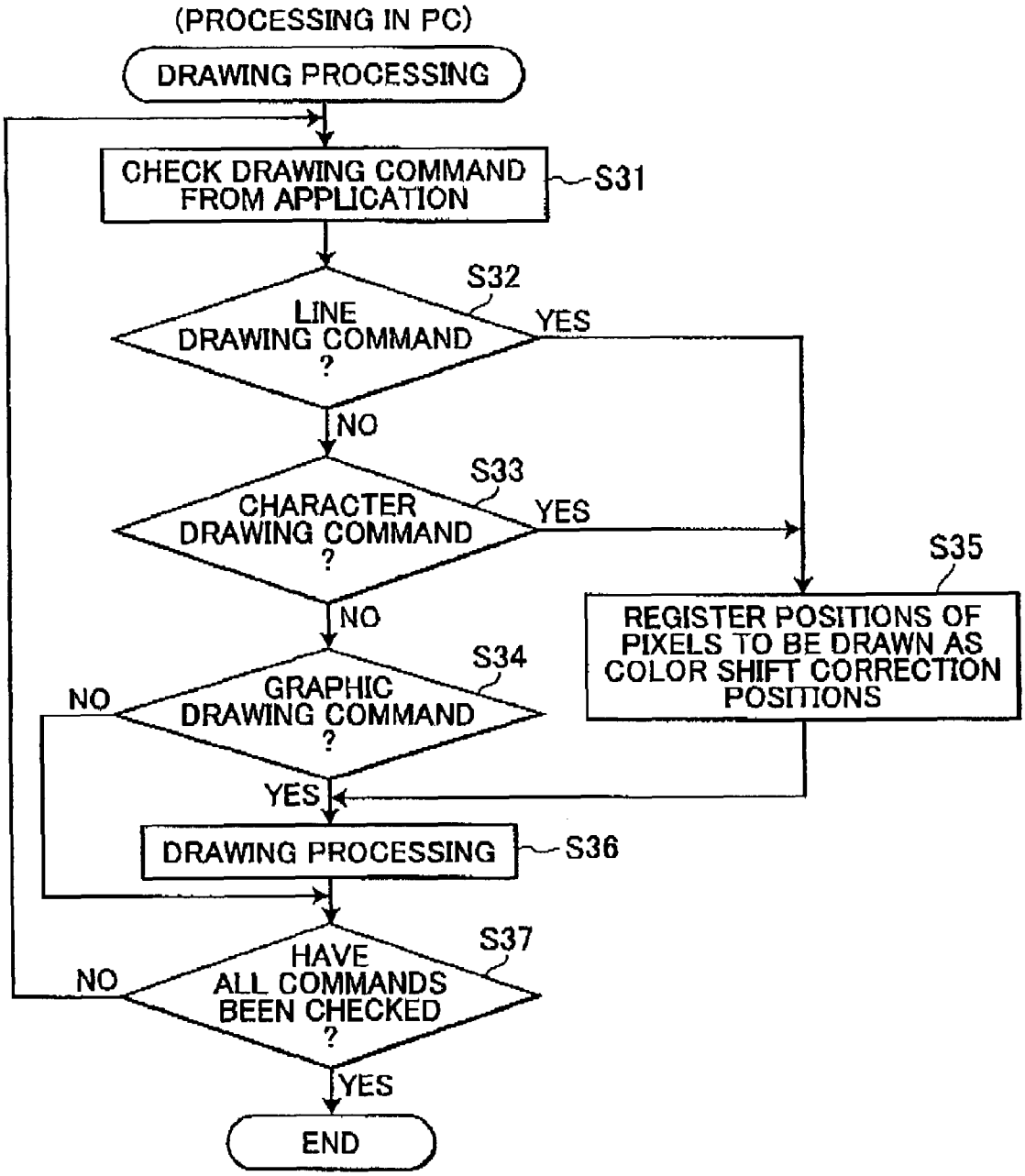
FIG. 8 is a flowchart showing a drawing processing in the print processing of FIG. 7.
Figure 9:
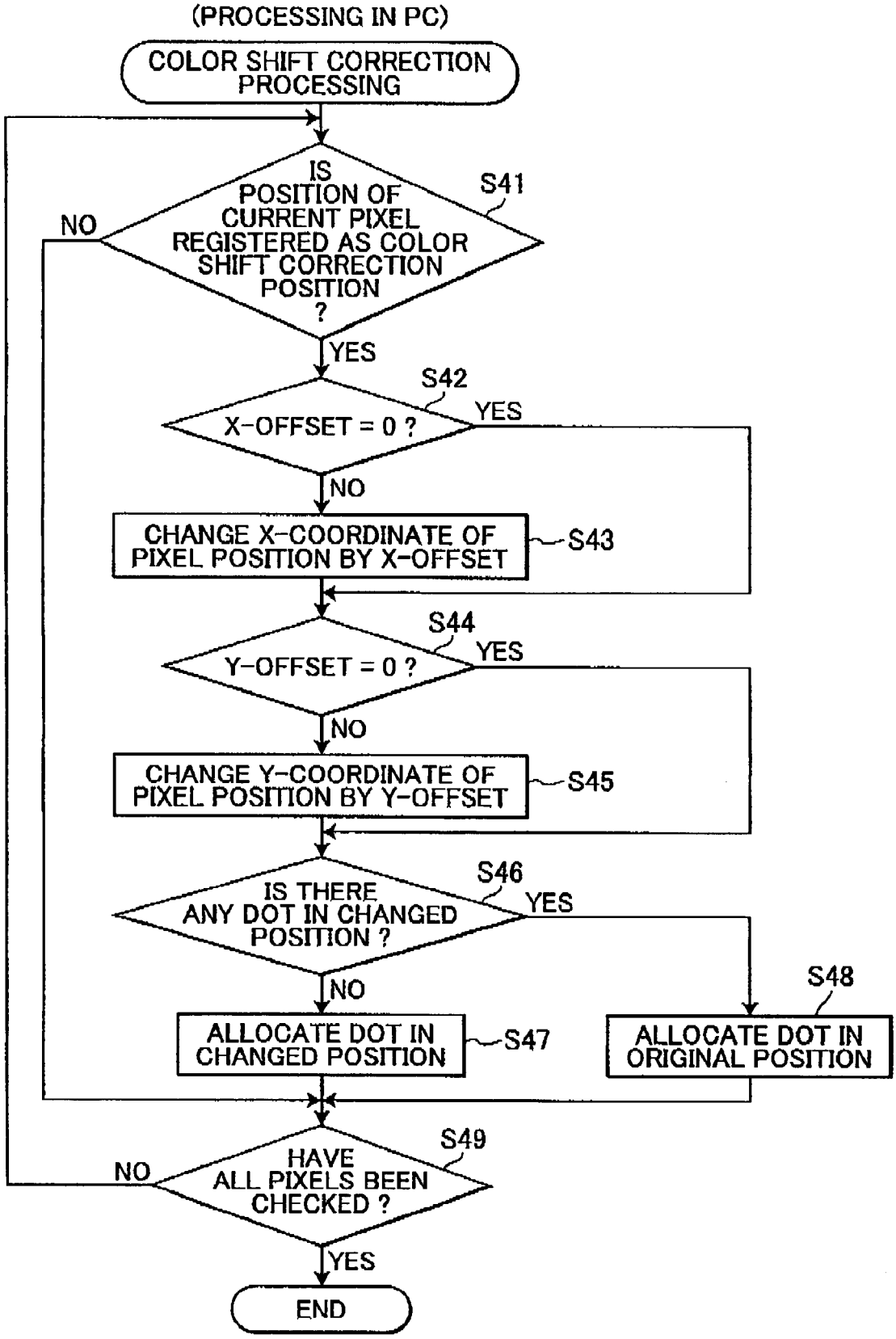
FIG. 9 is a flowchart showing a color shift correction processing in the print processing of FIG. 7.

FIGS. 7 through 9 are flowcharts showing a print processing executed by a printer driver. In S21, the CPU 121 of the PC 120 inputs a graphic drawing command, a line drawing command, and a character drawing command from application software. In S22, the CPU 121 executes a drawing processing according to these drawing commands. This drawing processing will be described later with reference to FIG. 8. In S23 the CPU 121 converts the colors of RGB into the colors of CMYK, and in S24 executes a halftone processing. The color conversion processing and the halftone processing are similar to those in the first embodiment.

In S25 the CPU 121 executes a color shift correction processing, and in S26 outputs the image information to the color electrophotographic printer 1. The color shift correction processing will be described later with reference to FIG. 9.

The drawing processing will be described with reference to FIG. 8. In the drawing processing, in S31 the CPU 121 checks the drawing command inputted from application software. In S32, the CPU 121 determines whether the drawing command is a line drawing command. If the drawing command is a line drawing command (S32: Yes), in S35 the CPU 121 registers (stores) the positions of the pixels drawn by the drawing command as the color shift correction positions in a predetermined work area of the RAM 123, and in S36 executes the drawing processing. If the drawing command is not a line drawing command (S32: No), in S33 the CPU 121 determines whether the drawing command is a character drawing command. If the drawing command is a character drawing command (S33: Yes), in S35 the CPU 121 registers the positions of the pixels drawn by the drawing command as the color shift correction positions in the predetermined work area of the RAM 123, and in S36 executes the drawing processing.

If the drawing command is not a character drawing command (S33: No), in S34 the CPU 121 determines whether the drawing command is a graphic drawing command. If the drawing command is a graphic drawing command (S34: Yes), in S36 the CPU 121 executes the drawing processing without registering the positions of the pixels in the RAM 123 because the color shift correction for the positions of the pixels need not be performed.

The drawing processing in S36 is processing for creating image data for executing printing based on the drawing command and for storing the image data in a predetermined area of the hard disk 124. If the drawing processing has been completed, or if the drawing command is not a graphic drawing command (S34: No), in S37 the CPU 121 determines whether the processing for all the drawing commands inputted from application software have been completed. If there is yet any unprocessed drawing command (S37: No), the processing returns to S31. If all the drawing commands have already been processed (S37: Yes), the drawing processing ends.

The color shift correction processing will be described with reference to FIG. 9. In the color shift correction processing, the processing is executed for each pixel. In S41, the CPU 121 determines whether the position of the pixel to be processed is registered as the color shift correction position in the predetermined work area of the RAM 123. If the pixel position is registered as the color shift correction position (S41: Yes), the processing in S42 to S48 are executed, however, since these processing are similar to the processing in S4 to S30 in FIG. 5, the detailed description thereof will be omitted. If the pixel position is not registered as the color shift correction position in S41 (S41: No), or if the processing in S47 and S48 have been completed, in S49 the CPU 121 determines whether the processing for all the pixels constituting the image have been completed. If there are yet any unprocessed pixels (S49: No), the processing returns to S41. If all the pixels have already been processed (S49: Yes), the color shift correction processing ends.

As described above, in the print processing executed by the printer driver according to the second embodiment, the type of an image is determined according to the drawing commands created by application software. If the image is not a natural picture, color shift correction processing is executed. Thus, when one printing surface includes a line drawing, characters, and a graphic, the color shift correction processing is performed for a line drawing or characters, and the color shift correction processing is not performed for a natural picture such as a graphic.

In the image recording apparatus and image processing program according to the above-described first and second embodiments, color shift can be prevented at a higher precision and printing can be performed in higher quality compared with a case in which color shift is corrected for each color or for each line in vertical and horizontal direction (the main scanning direction and sub-scanning direction).

While the invention has been described in detail with reference to the above aspects thereof, it would be apparent to those skilled in the art that various changes and modifications may be made therein without departing from the spirit of the invention.

For example, in the above-described embodiments, a color electrophotograhic printer 1 is employed as an apparatus for performing printing, however, an inkjet printer, a copying machine provided with a scanner for reading images, or a facsimile machine for receiving image information via a communication line and for printing an image may also be employed.

Further, the halftone processing in the above-described embodiments sets binary values for determining whether dots are formed. However, large-sized dots, middle-sized dots, and small-sized dots may be set in forming dots.

Further, in the above-described embodiments, if a dot already exists in the changed position, in S10 (FIG. 5) or in S48 (FIG. 9) the CPU 22 or the CPU 121 allocates the dot in the original position. However, if the dot is changed by two dots and then a dot already exists in that changed position, the CPU 22 or the CPU 121 may allocate the dot at a position which is returned by one dot from the changed position (i.e., the position between the original position and the changed position).

What is claimed is:

1. An image recording apparatus comprising:

an inputting unit that inputs image information on an image;

a half-tone processing unit that performs, based on the image information, a half-tone process for setting a plurality of dots to be printed on a recording medium;

a printing unit that prints the plurality of dots on the recording medium;

a correction-value storing unit that stores a set of correction values for correcting positions of the plurality of dots on the recording medium, the set of correction values including at least one correction value that is provided for each of the positions of the plurality of dots; and a dot-position correcting unit that corrects the positions of the plurality of dots based on the set of correction values, thereby obtaining output positions for printing the plurality of dots on the recording medium.

2. The image recording apparatus according to claim 1, wherein the at least one correction value includes both a first-direction correction value for correcting the position of each of the plurality of dots in a first direction in which the recording medium is conveyed, and a second-direction correction value for correcting the position of each of the plurality of dots in a second direction perpendicular to the first direction; and wherein the dot-position correcting unit corrects the position of each of the plurality of dots in the first direction based on the first-direction correction value, and corrects the position of each of the plurality of dots in the second direction based on the second-direction correction value.

3. The image recording apparatus according to claim 1, wherein the image is constituted by a plurality of colors;

wherein the half-tone processing unit sets the plurality of dots for each of the plurality of colors;

wherein the correction-value storing unit stores the set of correction values for each of the plurality of colors; and wherein the dot-position correcting unit corrects the positions of the plurality of dots based on the set of correction values for each of the plurality of colors.

4. The image recording apparatus according to claim 1, further comprising:

an image-type determining unit that determines a type of the image inputted by the inputting unit; and a correction preventing unit that prevents the dot-position correcting unit from correcting the positions of the plurality of dots when the image-type determining unit determines that the type of the image is a natural image.

5. The image recording apparatus according to claim 4, wherein the image information includes a filename having an extension; and wherein the image-type determining unit determines the type of the image-based on the extension.

6. The image recording apparatus according to claim 4, wherein the image contains at least one image part;

wherein the image information includes a drawing command indicative of a type of the at least one image part; and wherein the image-type determining unit determines the type of the at least one image part based on the drawing command.

7. The image recording apparatus according to claim 6, wherein the at least one image part includes a graphic drawing part, a line drawing part, and a character drawing part;

wherein the drawing command includes a graphic drawing command indicative of the graphic drawing part, a line drawing command indicative of the line drawing part, and a character drawing command indicative of the character drawing part;

wherein the dot-position correcting unit corrects the positions of the plurality of dots when the drawing command is one of the line drawing command and the character drawing command; and wherein the correction preventing unit prevents the dot-position correcting unit from correcting the positions of the plurality of dots when the drawing command is the graphic drawing command.

8. The image recording apparatus according to claim 1, wherein the dot-position correcting unit comprises:

a dot-position changing unit that changes each of the positions of the plurality of dots by a distance indicated by the at least one correction value, and that temporarily stores a changed position in a memory;

a dot-existence determining unit that determines whether a dot already exists in the changed position; and a dot allocating unit that allocates a dot in the changed position when no dot exists in the changed position, and allocates a dot in an original position when a dot already exists in the changed position.

9. A storage medium storing a set of program instructions executable on an image processing apparatus, the set of program instructions comprising:

inputting image information on an image;

performing, based on the image information, a half-tone process for setting a plurality of dots to be printed on a recording medium; and correcting positions of the plurality of dots on the recording medium based on a set of correction values stored in a correction-value storing unit, the set of correction values including at least one correction value that is provided for each of the positions of the plurality of dots, thereby obtaining output positions for printing the plurality of dots on the recording medium.

10. The storage medium according to claim 9, wherein the at least one correction value includes both a first-direction correction value for correcting the position of each of the plurality of dots in a first direction in which the recording medium is conveyed, and a second-direction correction value for correcting the position of each of the plurality of dots in a second direction perpendicular to the first direction; and wherein the instructions for correcting positions include correcting the position of each of the plurality of dots in the first direction based on the first-direction correction value, and correcting the position of each of the plurality of dots in the second direction based on the second-direction correction value.

11. The storage medium according to claim 9, wherein the image is constituted by a plurality of colors;

wherein the instructions for performing a half-tone process include setting the plurality of dots for each of the plurality of colors;

wherein the correction-value storing unit stores the set of correction values for each of the plurality of colors; and wherein the instructions for correcting positions include correcting the positions of the plurality of dots based on the set of correction values for each of the plurality of colors.

12. The storage medium according to claim 9, wherein the set of program instructions further comprises:

determining a type of the image; and preventing the instructions for correcting positions from correcting the positions of the plurality of dots when the type of the image is determined to be a natural image.

13. The storage medium according to claim 12, wherein the image information includes a filename having an extension; and wherein the instructions for determining a type of the image include determining the type of the image based on the extension.

14. The storage medium according to claim 12, wherein the image contains at least one image part;

wherein the image information includes a drawing command indicative of a type of the at least one image part; and wherein the image-type determining unit determines the type of the at least one image part based on the drawing command.

15. The storage medium according to claim 14, wherein the at least one image part includes a graphic drawing part, a line drawing part, and a character drawing part;

wherein the drawing command includes a graphic drawing command indicative of the graphic drawing part, a line drawing command indicative of the line drawing part, and a character drawing command indicative of the character drawing part;

wherein the instructions for correcting positions corrects the positions of the plurality of dots when the drawing command is one of the line drawing command and the character drawing command; and wherein the instructions for preventing correction include preventing the instructions for correcting positions from correcting the positions of the plurality of dots when the drawing command is the graphic drawing command.

16. The storage medium according to claim 9, wherein the instructions for correcting positions comprise:

changing each of the positions of the plurality of dots by a distance indicated by the at least one correction value, and temporarily storing a changed position in a memory;

determining whether a dot already exists in the changed position; and allocating a dot in the changed position when no dot exists in the changed position, and allocating a dot in an original position when a dot already exists in the changed position.

* * * * *